US008712072B2

(12) United States Patent
Lynn et al.

(10) Patent No.: US 8,712,072 B2
(45) Date of Patent: Apr. 29, 2014

(54) MULTI-WIRED ANTENNA FOR MOBILE APPARATUS

(75) Inventors: Lapoe Lynn, Los Altos, CA (US); Hongbin Tong, Fremont, CA (US)

(73) Assignee: Telegent Systems, Inc., Sunnyvale, CA (US)

( * ) Notice: Subject to any disclaimer, the term of this patent is extended or adjusted under 35 U.S.C. 154(b) by 311 days.

(21) Appl. No.: 13/328,932

(22) Filed: Dec. 16, 2011

(65) Prior Publication Data

US 2012/0188462 A1 Jul. 26, 2012

Related U.S. Application Data

(60) Provisional application No. 61/424,613, filed on Dec. 17, 2010.

(51) Int. Cl.
*H04R 1/10* (2006.01)

(52) U.S. Cl.
USPC ..... 381/74; 381/77; 381/80; 381/309; 381/311; 381/376

(58) Field of Classification Search
USPC ..... 381/74, 77, 80, 309, 311, 376; 343/850, 343/859, 906; 455/403, 193.1, 569.1, 455/575.2, 269, 270
See application file for complete search history.

(56) References Cited

U.S. PATENT DOCUMENTS

2006/0050893 A1* 3/2006 Petros ..... 381/74
2008/0198090 A1 8/2008 Yamaguchi et al.
2009/0015505 A1 1/2009 Nagano et al.

OTHER PUBLICATIONS

International Search Report and Written Opinion for PCT/US11/65651 filed on Dec. 16, 2011.

* cited by examiner

*Primary Examiner* — Vivian Chin
*Assistant Examiner* — Paul Kim
(74) *Attorney, Agent, or Firm* — Richard T. Ogawa; Ogawa P.C.

(57) ABSTRACT

The present invention is directed to mobile devices. More specifically, embodiments of the present invention provide one or more antennas embedded into headsets and/or earphone for mobile devices. In an embodiment, an antenna wire having a length of about 100 mm to 150 mm is implement as a part of a headset or an earphone that has an overall length of at least 90 cm, where the antenna wire is substantially insulated from the audio wire(s). The headset or earphone is connected to a mobile device that receives television signals from the antenna. In a specific embodiment, a mobile device includes a connection circuit that is configured to separate television signals form audio signals. In an exemplary embodiment, various components of the mobile device positioned at predetermine location away from the connection circuit to reduce noise and/or interference.

22 Claims, 6 Drawing Sheets

MULTI-WIRED ANTENNA FOR MOBILE APPARATUS

CROSS-REFERENCES TO RELATED APPLICATIONS

This application claims priority to U.S. Provisional Patent Application No. 61/424,613, filed Dec. 17, 2010, which is incorporated by reference for all purposes.

STATEMENT AS TO RIGHTS TO INVENTIONS MADE UNDER FEDERALLY SPONSORED RESEARCH AND DEVELOPMENT

NOT APPLICABLE

REFERENCE TO A "SEQUENCE LISTING," A TABLE, OR A COMPUTER PROGRAM LISTING APPENDIX SUBMITTED ON A COMPACT DISK

NOT APPLICABLE

BACKGROUND OF THE INVENTION

The present invention is directed to mobile devices. More specifically, embodiments of the present invention provide one or more antennas embedded into headsets and/or earphone for mobile devices.

In recent years, portable communication devices, such as mobile phone, tablet computers, personal digital assistants, have become ubiquitous. Many people carry their cellular phone with them for their daily activities. The functions of these portable communication devices grow from voice communication, texting, and personal information management to games, social networking, multimedia entertainment, and others.

One use of portable communication devices has been watching videos and/or other multimedia contents. For example, to watch videos on a cell phone, the user can (1) preload the video content onto the cell phone; (2) stream the video over the data network; or (3) receive video/television broadcast signals over the air.

There are pros and cons with each of the options above. But it is to be appreciated that playback television broadcast signals is an attractive option, where available, for users. This is because users are able to watch fresh contents without congesting the data network.

Over the past, various types of mobile devices, such as mobile phones, have been proposed to receive television broadcasting. One of the challenges for those products is to have an antenna that is capable of receiving good signals and at the same time portable.

Therefore, it is desirable to have novel antennas for mobile devices.

BRIEF SUMMARY OF THE INVENTION

The present invention is directed to mobile devices. More specifically, embodiments of the present invention provide one or more antennas embedded into headsets and/or earphone for mobile devices. In an embodiment, an antenna wire having a length of about 100 mm to 150 mm is implemented as a part of a headset or an earphone that has an overall length of at least 90 cm, where the antenna wire is substantially insulated from the audio wire(s). The headset or earphone is connected to a mobile device that receives television signals from the antenna. In a specific embodiment, a mobile device includes a connection circuit that is configured to separate television signals form audio signals. In an exemplary embodiment, various components of the mobile device positioned at predetermine location away from the connection circuit to reduce noise and/or interference.

In various embodiments, the present invention provides headset for mobile devices (e.g., mobile phone, mobile computer, etc.) where the headset includes multiple antennas used to receive signals of different frequency ranges in addition to the audio cable(s). For example, the headset comprises a pair of earphones that are to be connected to mobile device through one or more conductive wires, and the antennas are bundled with the conductive wires by insulating materials. The lengths of the antennas are specifically configured to match certain different frequency spectrums, such as VHF and UHF frequency ranges. In a specific embodiment, the headset is connected to a region of a mobile device where the audio signals generated by the mobile device is insulated from the signals received by the antennas.

According to an embodiment, the present invention provides a headset device for coupling to mobile devices. The device includes a first audio wire, the first audio wire being associated with a first audio channel, where the first audio wire is characterized by a first length of at least 350 mm, the first audio wire having a first end and a second end, the first length being associated with a first frequency range, the first frequency range comprises a first broadcast RF frequency, the first audio wire having a first axis. The device also includes a first transducer, the first end being electrically coupled to the first transducer. The device further includes a connector section, the connector section comprising at least a first connector pin and a second connector pin, the first connector pin being electrically coupled to the second end of the first audio wire. The device additionally includes an antenna wire being characterized by a second length of about 80 mm to 180 mm, the antenna wire having a second axis, the second length being associated with a second frequency range, the second frequency range being different from the first frequency range, the second axis and the first axis being separated by at least 0.1 mm, the antenna wire being electrically coupled to a connector section pin.

The device may further comprise a secondary antenna wire having a third length, the third length being associated with a third frequency range.

In an embodiment, the first frequency range and the second frequency range partially overlap.

In an embodiment, the first antenna wire and the first audio wire being electrically coupled to each other at the connector section.

In an embodiment, the second length is about 115 mm.

The device may further comprise a plastic sheath enclosing the first audio.

The device may further comprise a microphone wire insulated from the first audio wire.

The device may further comprise a second audio wire, the second audio wire being associated with a second audio channel, the first audio wire and the second audio wire being electrically insulated from each other.

In an embodiment, the connector section comprises a 2.5 mm connector.

In an embodiment, the connector section comprises a USB connector.

In an embodiment, the antenna wire is substantially free from twisting.

The device may further comprise a ground wire electrically insulated from the first audio wire and the second audio wire.

In an embodiment, the antenna wire is electrically coupled to the first audio wire, a ground wire, or a microphone wire at the connection section.

the second axis and the first axis are separated by at least 0.5 mm.

According to another embodiment, the present invention provides a mobile device. The device includes a processor and a wireless communication module, the wireless communication module being configured to connect to one or more wireless communication networks. The device also includes a display module, the display module being electrically coupled to the processor. The device also includes a mobile television module, the mobile television receiver module being configured to process television signals and send signals to the display module through a display bus. In addition, the device includes an audio processing module configured to process audio signals. The device also includes a connection housing, the connection housing being disengageably coupled to a headset, the headset comprising a first audio cable and an antenna, the antenna being characterized by a length of about 80 mm to 180 mm, the audio cable being associated with a first frequency range, and the antenna being associated with a second frequency range, the first frequency range including an RF broadcast frequency, the first frequency range and the second frequency range being different. The device also includes a connector module electrically coupled to the connection housing, the connector module being configured to separate television signals from audio signals, the connector module being configured to receive the television signals from the antenna and transmit the television signals to the mobile television module, the connector module further being configured to receive the audio signals from the audio processing module and send the audio signals to the one or more audio cables, the connector module being positioned at least 10 mm away from the processor.

The device may further include a shielding can enclosing the audio processing module.

In an embodiment, the connection housing comprising a first pin and a second pin, the first pin being electrically coupled to a first audio cable of the headset, the second pin being electrically coupled to the antenna, the first pin being electrically coupled to the second pin through at least a capacitor.

In an embodiment, the connector housing is configured to accommodate a USB connector.

In an embodiment, the connector housing is configured to accommodate a 2.5 mm jack connector.

The device may further include an LCD display coupled to the display module.

The device may further include a memory module, the memory module being insulated from connector module.

According to yet another embodiment, the present invention provides a headset device for coupling to mobile devices. The device comprises a first antenna, first antenna being characterized by a first length of at least 350 mm, the first antenna having a first end and a second end, the first length being associated with a first frequency range. The first frequency range comprises a first broadcast RF frequency, the first antenna having a first axis. The device comprises a lanyard, the first end being electrically coupled to the lanyard. The device also comprises a connector section, the connector section comprising at least a first connector pin, the first connector pin being electrically coupled to the second end of the first antenna. The device further comprises an second antenna wire being characterized by a second length of about 80 mm to 180 mm, the second antenna wire having a second axis, the second length being associated with a second frequency range, the second frequency range being different from the first frequency range, the second axis and the first axis being separated by at least 0.1 mm, the second antenna being electrically coupled to a connector section pin.

Embodiments of the present invention provide numerous advantages over conventional systems. With multiple antennas that are specifically configured to receive different radio frequency spectra, a headset according to the present invention convenient and effectively afford good reception of mobile device that it attaches to. It is to be appreciated that the headset can be easily adapted to be compatible with both conventional mobile devices and mobile systems. In various embodiments, the headset is capable transmitting audio and/or video signal generated by the mobile device and providing radio frequency reception, which may include FM, AM, UHF, VHF, and others. In a specific embodiment, the headset includes a microphone for capture user speech and/or voice commends. It is to be appreciated that there are other embodiments as well.

DETAILED DESCRIPTION OF THE INVENTION

Figure 1:
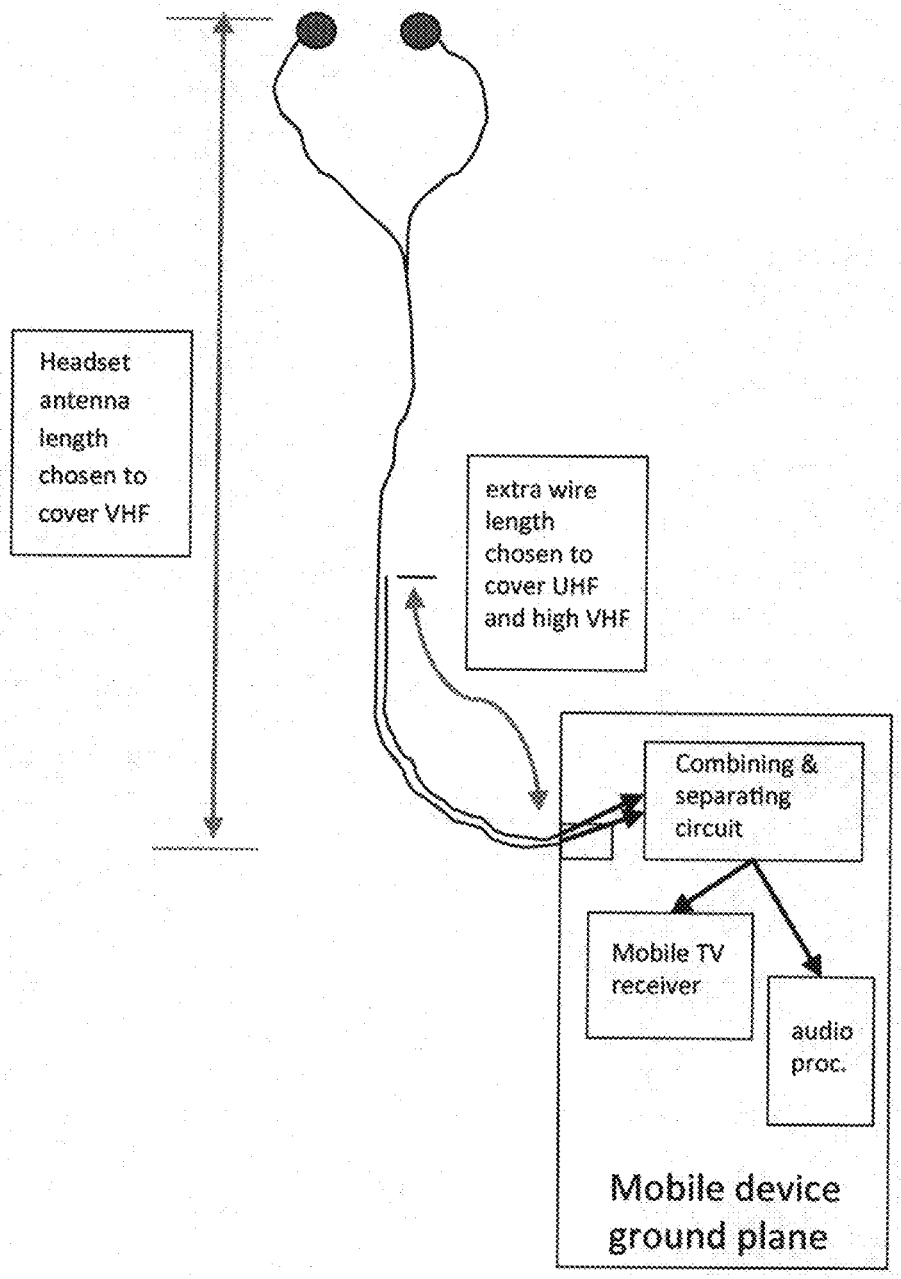
FIG. 1 is a simplified diagram illustrating an multi-wire headset antenna connected to a mobile device according to an embodiment of the present invention.

The present invention is directed to mobile devices. More specifically, embodiments of the present invention provide one or more antennas embedded into headsets and/or earphone for mobile devices. In an embodiment, an antenna wire having a length of about 100 mm to 150 mm is implemented as a part of a headset or an earphone that has an overall length of at least 90 cm, where the antenna wire is substantially insulated from the audio wire(s). The headset or earphone is connected to a mobile device that receives television signals from the antenna. In a specific embodiment, a mobile device includes a connection circuit that is configured to separate television signals form audio signals. In an exemplary embodiment, various components of the mobile device positioned at predetermine location away from the connection circuit to reduce noise and/or interference.

In various embodiments, the present invention addresses how to add multiple wires in a headset antenna to improve antenna performance across a wide frequency range. Aspects of the present invention can be applied to portable devices (e.g., mobile phones) for analog TV, FM radio and digital TV applications. It is to be appreciated that embodiments of the present invention can be applied more generally to any wireless system, which spans a broad frequency range using headset only.

Normally, a whip antenna is used for TV enabled phones; in contrast, most phones that use stand-alone FM radio chipsets rely on the headset to function as the FM antenna. In contrast, embodiments of the present invention provide an integrated design by adding multiple short wires in the headset antenna to cover much broader range of frequencies for multiple applications. For mobile TV applications, the added wires can replace the whip antenna to cover the UHF and VHF-band3 bands. Combined with the original headset antenna, this multi-wire antenna can cover all required FM, VHF1, VHF-band3 and UHF bands for mobile TV and FM applications, while the costly, whip or rod antenna can be removed, saving cost and precious volume/area inside the portable device. Furthermore by enabling the removal of movable parts associated with the whip antenna, the mechanical robustness and reliability of the portable device is improved.

It is to be appreciated that embodiments of the present invention can be used with mobile TV products. Within the last few years, mobile TV products have emerged which can receive and display analog TV, FM radio, and digital TV (e.g. DVB-H, DVH-T, ISDB-T, CMMB and ATSC) signals on a handheld device such as mobile phone or PDA.

Many handheld devices that support the FM radio application use a headset, or so-called earphone, as the FM radio antenna, but most devices supporting the mobile TV application use a whip antenna (sometimes called a rod antenna), to receive the TV signal. However, because the broadcast TV+FM band covers an extremely wide range of frequencies (roughly 50 Mhz to 860 Mhz), each of these antennas will have degraded performance at some frequencies in the TV+FM band.

For instance, FM radio uses from 88 MHz to 108 MHz in USA. TV application takes VHF1 (48 MHz to 85 MHz), VHF-band3 (175 MHz to 213 MHz) and UHF (470M to 860 MHz) bands. According to antenna theory, a monopole antenna has the peak gain near its resonant frequency (where the antenna physical length is equal to a quarter of a wavelength ($\lambda/4$)). That is the reason normally the FM Headset antenna length is about 90 cm to 150 cm and the TV whip antenna is about 15 cm. The length variation makes the antenna get the peak gain for its individual frequency band.

The antenna gain mainly defines how much signal the receiver can capture and signal to noise ratio (SNR) the receiver can see, therefore, it directly affects TV/FM performance metrics such as sensitivity level, picture and audio quality. To get better antenna gain across the frequency band of interest is one of the most important goals of antenna design.

Various embodiments of the present invention address how to add multiple wires in a headset antenna to improve antenna performance across a wide frequency range. The invention can be applied to portable devices for analog TV, FM radio and digital TV applications and can be applied more generally to any wireless system which spans a broad frequency range using headset only.

Normally, a whip antenna is used for TV enabled phones; in contrast, most phones that use stand-alone FM radio chipsets rely on the headset to function as the FM antenna. In contrast, embodiments of the present invention provide an integrated design by adding multiple short wires in the headset antenna to cover much broader range of frequencies for multiple applications. For mobile TV application, the added wires can replace the whip antenna to cover the UHF and VHF-band3 bands. Combined with the original headset antenna, this multi-wire antenna can cover all required FM, VHF1, VHF-band3 and UHF bands for mobile TV and FM applications, while the costly, whip or rod antenna can be removed, saving cost and precious volume/area inside the portable device. Furthermore by enabling the removal of movable parts associated with the whip antenna, the mechanical robustness and reliability of the portable device is improved.

As aforementioned, normally, a whip antenna is used for TV enabled phones, while most phones using stand-alone FM radio chipsets rely on the headset to function as the FM antenna. Both the whip antenna and the headset antenna act predominantly as electric monopoles referenced to the ground plane of the mobile device (e.g., handset, cellphone, or others). Antennas used in this mode tend to have a local maximum in antenna gain for frequencies where the wavelength of the signal is close to 4× times the length of the monopole element (and thus, the prevalence of the common ¼ wavelength monopole antenna). While matching techniques may be applied to move the local maximum away from the 4× relationship, there will still be a local maximum where the antenna gain and bandwidth will decrease as the frequency is moved away from the optimum point. Typically, the decrease in antenna performance is very large as the frequency deviates by from the optimum frequency; although there may be other local maxima near certain multiples of the optimum frequency (eg. 3× the optimum). Therefore, it is very difficult to use a single electric monopole antenna to cover the broadcast TV frequency range of 48 MHz to 860 MHz with good antenna gain throughout. For example, a 1.3 m long monopole antenna (typical for many headset antennas) will have local maxima near 57.5 MHz and 173 MHz and 460 MHz (antenna is ¼×, ¾×, or ⁹⁄₄×$\lambda$), but may have poor performance near 577 Mhz and 805 Mhz (antenna is 2.5×$\lambda$ and 3.5×$\lambda$). On the other hand, a 15 cm long monopole antenna (typical for many whip antennas implementations) will have best performance near 500 MHz (¼×$\lambda$), but worse performance in VHF (50-200 MHz), because the antenna length is much shorter than $\lambda/4$ for the frequency and the antenna gain decreases with $(1/\lambda)^3$.

Thus it is to be appreciated that embodiments of the present invention provide a way to provide good antenna gain for both FM and TV bands by adding multiple short wires in conventional headset cable. FIG. 1 is a simplified diagram illustrating an multi-wire headset antenna connected to a mobile device according to an embodiment of the present invention. This diagram is merely an example, which should not unduly limit the scope of the claims. One of ordinary skill in the art would recognize many variations, alternatives, and modifications.

As shown in FIG. 1, one or more wires with different lengths are added to a conventional headset. Each wire are insulated from the other wires in the headset, and each wire length is chosen to provide improved antenna gain in a different frequency band. For example, for FM radio frequency reception, a length of at least 600 mm is need for the antenna; for UHF and other type of TV signals reception, a relatively shorter (e.g., 100 mm to 200 mm length) antenna length is used.

After combining the signal from each wire together, the combined antenna gain is improved. Care are taken in choosing each wire length to ensure that antenna interaction between the various wires is minimized for frequencies of concern. A small circuit is used to separate the audio from the RF signals. In an embodiment, the same circuit is used to combine the RF signal from the various wires (including the original wires in the conventional headset) into one or more signals for the TV receiver. In one embodiment, the extra wires are shorted to one or more of the original headset wires at the connector, and the part of the combining circuit is eliminated.

Figure 2:
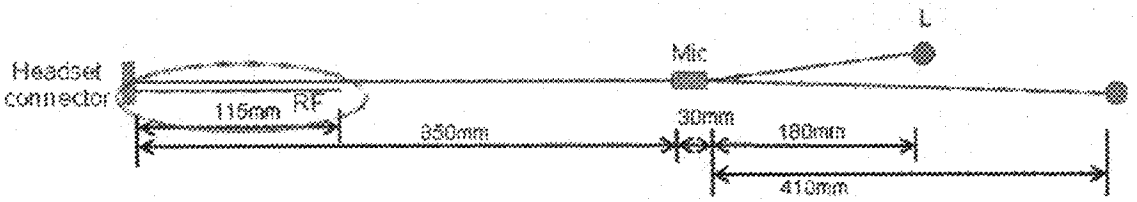
FIG. 2 is a simplified diagram illustrating an exemplary headset with short antenna wire according to an embodiment of the present invention.

Unlike existing headset antennas designed for mobile TV, this simple modification requires no special shielding or coaxial cables, and provides a cost-effective solution that is easy to manufacture. Depending on the signals to be received, the number and/or length of the antenna wire(s) in addition to the existing headset wires can be varied. FIG. 2 is a simplified diagram illustrating an exemplary headset with short antenna wire according to an embodiment of the present invention. This diagram is merely an example, which should not unduly limit the scope of the claims. One of ordinary skill in the art would recognize many variations, alternatives, and modifications.

As shown in FIG. 2, an additional 115 mm short wire is added to the headset as an UHF antenna.

Typically, the conventional headset contains 4 wires and they are Audio Left, Audio Right, Microphone, and Ground.

The original 4 wires will play two roles. They are for conducting audio signals and are also used as the FM/VHF1 band antenna. The additional short wire(s) acts as a VHF3 and UHF band antennas. The added wires may be connected to any unused/extra pins on the connector and then must be combined with the other wires using the combining circuit. Alternately, the additional wires may be electrically shorted to any of the original wires only at the headset connector (but must be insulated from the other wires otherwise).

In various embodiments, the headset's overall cable length is recommended to be about 900 mm to 1200 mm. The number of short wires to be added can be selected. A 100 mm to 150 mm long wire is used as the shortest wire required to boost UHF antenna performance. In certain embodiments, a 300 mm to 450 mm long medium wire is an option, which can be used to boost VHF3 band performance. A small separation between the audio wires and parallel short wires is preferred. The separation can be as small as 0.5 mm. Twisting or winding of the wires around each other (eg. as is commonly done with twisted pair) are typically avoided.

Figure 3:
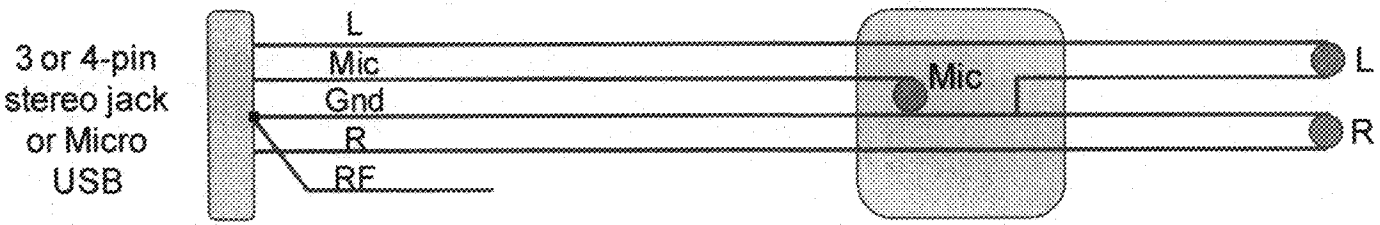
FIG. 3 is a simplified diagram illustrating connections of wires for a headset according to an embodiment of the present invention.

Wiring and/or connection of antenna and the headset wires can be set in various ways. FIG. 3 is a simplified diagram illustrating a connections of wires for a headset according to an embodiment of the present invention. This diagram is merely an example, which should not unduly limit the scope of the claims. One of ordinary skill in the art would recognize many variations, alternatives, and modifications. As shown, the RF wire is shorted to the ground wire at the stereo jack end, but insulated from other wires. For example, each of the wires are insulated from one another.

Figure 4:
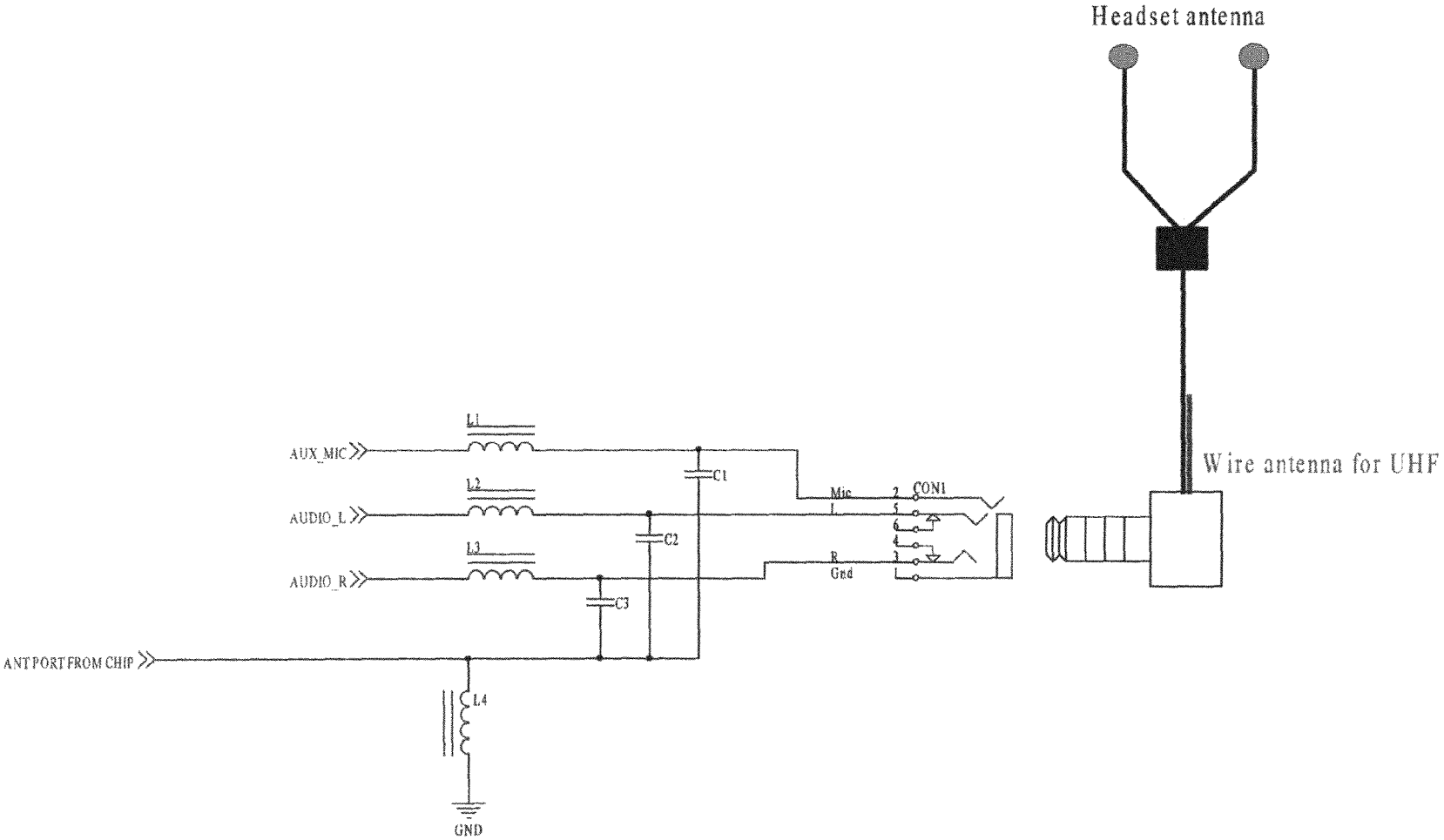
FIG. 4 is a simplified diagram illustrating a simple and cost-effective combining circuit according to an embodiment of the invention.

FIG. 4 is a simplified diagram illustrating a simple and cost-effective combining circuit according to an embodiment of the invention. This diagram is merely an example, which should not unduly limit the scope of the claims. One of ordinary skill in the art would recognize many variations, alternatives, and modifications. At RF frequencies, the capacitors effectively combine the headset wires and the additional short wires into one combined RF signal. The circuit also provides a diplexing function to separate the audio signal from the RF signal on the headset cable. The cost of the combining circuit is expected to be mere pennies at today's component prices.

In FIG. 4, CON1 is the connector for the headset that will be an example of the recommended invention used as a Mobile TV and FM antenna. The short wire is for the UHF antenna. Typically, it is a standard 2.5 mm audio jack or mini-USB connector and is used to connect the phone PCB to the headset cable. In this example, a standard audio jack is shown. There are 4 signals to consider in this example—L (audio left), R (audio right), Mic, and Gnd. If there are more than these 4 signals inside the headset cable, it is recommended to add a ferrite-bead—capacitor pair (eg. L1 & C1) to each of the additional signals. As an example, L1 thru L4 are ferrite beads for passing the low frequency (audio) signals, and C1 thru C3 are capacitors for passing ATV RF signal.

Figure 5:
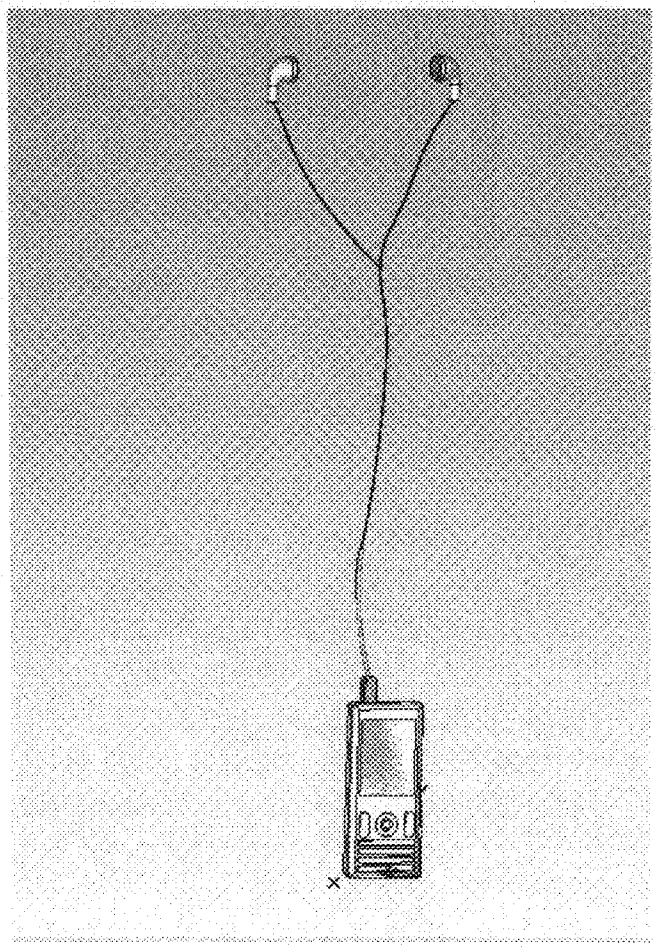
FIG. 5 is a simplified diagram illustrating a multi-wired antenna used in conjunction with a headset according to an embodiment of the present invention.

FIG. 5 is a simplified diagram illustrating a multi-wired antenna used in conjunction with a headset according to an embodiment of the present invention. This diagram is merely an example, which should not unduly limit the scope of the claims. One of ordinary skill in the art would recognize many variations, alternatives, and modifications.

It is to be appreciated that the multi-wired headsets according to various embodiments of the present invention can be cheaply implemented, in contrast to convention systems. For example, a conventional multi-wired headset typically requires the antenna to be implemented using insulated coaxial cable. Coaxial cable type of headset is expensive to make and typically too bulky to personal use.

Figure 6:
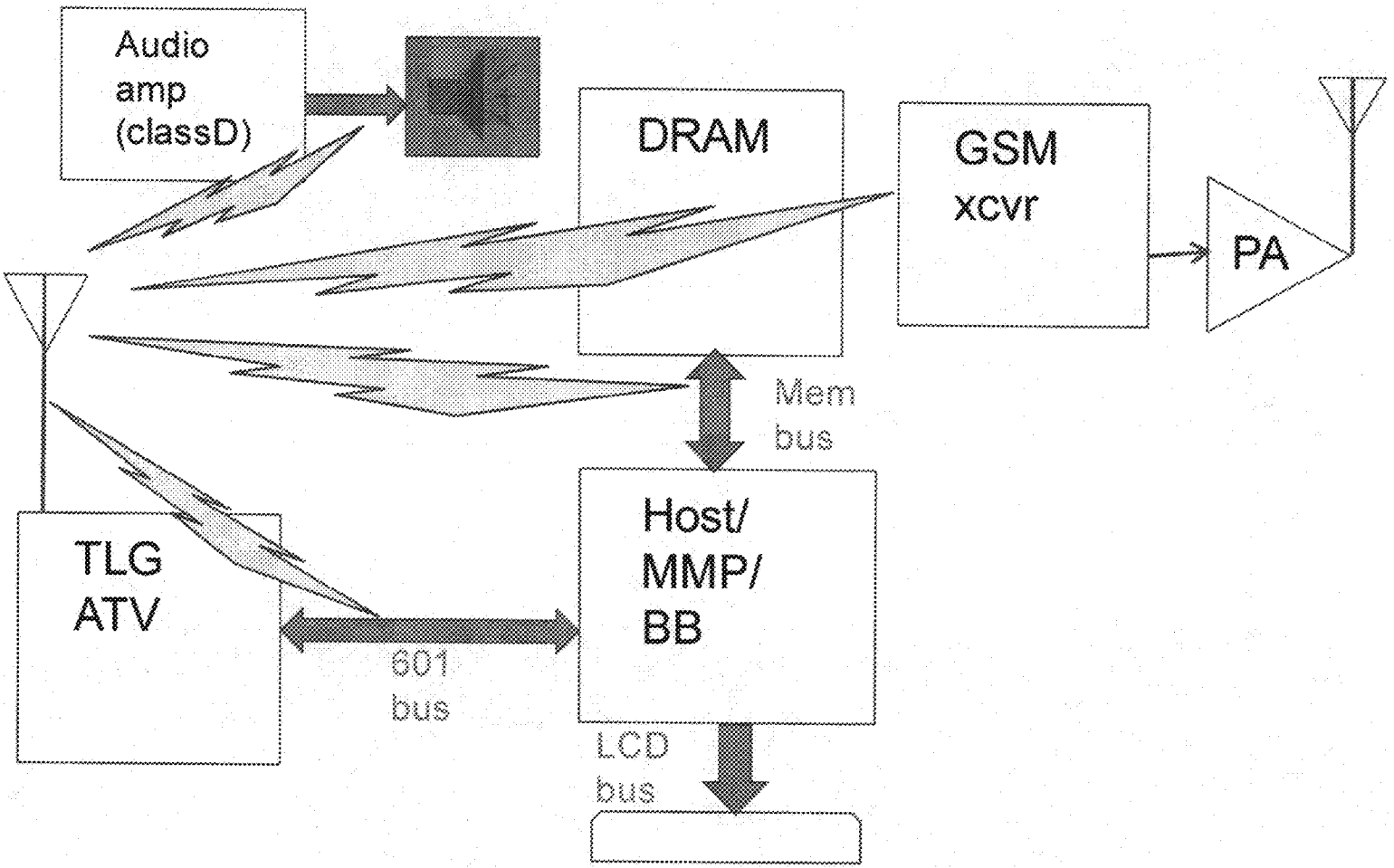
FIG. 6 is a simplified diagram illustrating interferences an antenna may introduce to a mobile device according to an embodiment of the present invention.

In various embodiments, mobile devices that utilizes the multi-wired antennas of the present invention are specifically designed to accommodate and reduce the interferences introduced by the short antenna wire(s) of the headset. FIG. 6 is a simplified diagram illustrating interferences an antenna may introduce to a mobile device according to an embodiment of the present invention. This diagram is merely an example, which should not unduly limit the scope of the claims. One of ordinary skill in the art would recognize many variations, alternatives, and modifications. In various embodiments, "uncontrolled" profile of TV antenna inside the phone is minimized. In term of placement of TV antenna and TLG IC relative to the LCD connector (especially a flex cable), the TV antenna are kept away from the TV RF area. Within the device, flex cable are avoided, and if possible, but if necessary, short, fixed, shielded flex cables are used. For example, if flex cable is used, EMI filters or series-R or shunt-C (in that order) are used to filter all digital lines before they get to the flex (closest to driver is best). The LCD itself may be hard-grounded to the PCB near the LCD connector. For the Memory bus DRAM-to-BB and/or MMP, the lowest possible IO drive strength is used. Additionally, short & straight routes are preferred, with shield with ground. Additionally, the memory bus is positioned away from the TLG IC. Particularly, memory bus and related components are not directly on flip side of board, or near the antenna connector/RF input circuitry. In a specific embodiment, the bus is buried between ground. Also, memory bus and Flash memory-to-BB/LCD are also kept away from TV RF area.

In various embodiments, grounding of wires involves having a solid ground plane with lots of vias. High-activity digital chips are not placed on opposite side of board from TLG area (eg. BB/MMP or DRAM). The TLG area shielding can are not shared with any of the above digital noise sources. If possible, all digital noise sources are placed under under shielding cans; for digital IC's that share a high-speed bus (e.g., BB, DRAM, Flash), best to share 1 large shielding can. Drive currents and slew rates on digital bus drivers are carefully controlled. In various embodiments, lowest possible drive strength/slew rate is recommended.

It is to be appreciated that there are other embodiments as well.

What is claimed is:

1. A headset device for coupling to mobile devices, the device comprising:

a first audio wire, the first audio wire being associated with a first audio channel, the first audio wire being characterized by a first length of at least 350 mm, the first audio wire having a first end and a second end, the first length being associated with a first frequency range, the first frequency range comprises a first broadcast RF frequency, the first audio wire having a first axis;

a first transducer, the first end being electrically coupled to the first transducer;

a connector section, the connector section comprising at least a first connector pin and a second connector pin, the first connector pin being electrically coupled to the second end of the first audio wire; and an antenna wire being characterized by a second length of about 80 mm to 180 mm, the antenna wire having a second axis, the second length being associated with a second frequency range, the second frequency range being different from the first frequency range, the second axis and the first axis being separated by at least 0.1 mm, the antenna wire being electrically coupled to a connector section pin.

2. The device of claim 1 further comprising a secondary antenna wire having a third length, the third length being associated with a third frequency range.

3. The device of claim 1 wherein the first frequency range and the second frequency range partially overlap.

4. The device of claim 1 first antenna wire and the first audio wire being electrically coupled to each other at the connector section.

5. The device of claim 1 wherein the second length is about 115 mm.

6. The device of claim 1 further comprising a plastic sheath enclosing the first audio.

7. The device of claim 1 further comprising a microphone wire insulated from the first audio wire.

8. The device of claim 1 further comprising a second audio wire, the second audio wire being associated with a second audio channel, the first audio wire and the second audio wire being electrically insulated from each other.

9. The device of claim 1 wherein the connector section comprises a 2.5 mm connector or a 3.5 mm connector.

10. The device of claim 1 wherein the connector section comprises a USB connector.

11. The device of claim 1 wherein the antenna wire is substantially free from twisting.

12. The device of claim 1 further comprising a ground wire electrically insulated from the first audio wire and the second audio wire.

13. The device of claim 1 wherein the antenna wire is electrically coupled to the first audio wire, a ground wire, or a microphone wire at the connection section.

14. The device of claim 1 wherein the second axis and the first axis are separated by at least 0.5 mm.

15. A mobile device comprising:

a processor;

a wireless communication module, the wireless communication module being configured to connect to one or more wireless communication networks;

a display module, the display module being electrically coupled to the processor;

a mobile television module, the mobile television receiver module being configured to process television signals and send signals to the display module through a display bus;

an audio processing module configured to process audio signals;

a connection housing, the connection housing being disengageably coupled to a headset, the headset comprising a first audio cable and an antenna, the antenna being characterized by a length of about 80 mm to 180 mm, the audio cable being associated with a first frequency range, and the antenna being associated with a second frequency range, the first frequency range including an RF broadcast frequency, the first frequency range and the second frequency range being different; and a connector module electrically coupled to the connection housing, the connector module being configured to separate television signals from audio signals, the connector module being configured to receive the television signals from the antenna and transmit the television signals to the mobile television module, the connector module further being configured to receive the audio signals from the audio processing module and send the audio signals to the one or more audio cables, the connector module being positioned at least 10 mm away from the processor.

16. The apparatus of claim 15 further comprising a shielding can enclosing the audio processing module.

17. The apparatus of claim 15 wherein the connection housing comprising a first pin and a second pin, the first pin being electrically coupled to a first audio cable of the headset, the second pin being electrically coupled to the antenna, the first pin being electrically coupled to the second pin through at least a capacitor.

18. The apparatus of claim 15 wherein the connector housing is configured to accommodate a USB connector.

19. The apparatus of claim 15 wherein the connector housing is configured to accommodate a 2.5 mm jack connector.

20. The apparatus of claim 15 further comprising an LCD display coupled to the display module.

21. The apparatus of claim 15 further comprising a memory module, the memory module being insulated from connector module.

22. A headset device for coupling to mobile devices, the device comprising:

a first antenna, first antenna being characterized by a first length of at least 350 mm, the first antenna having a first end and a second end, the first length being associated with a first frequency range, the first frequency range comprises a first broadcast RF frequency, the first antenna having a first axis;

a lanyard, the first end being electrically coupled to the lanyard;

a connector section, the connector section comprising at least a first connector pin, the first connector pin being electrically coupled to the second end of the first antenna; and an second antenna wire being characterized by a second length of about 80 mm to 180 mm, the second antenna wire having a second axis, the second length being associated with a second frequency range, the second frequency range being different from the first frequency range, the second axis and the first axis being separated by at least 0.1 mm, the second antenna being electrically coupled to a connector section pin.

* * * * *